US007068121B2

(12) United States Patent
Ding et al.

(10) Patent No.: US 7,068,121 B2
(45) Date of Patent: Jun. 27, 2006

(54) APPARATUS FOR SIGNAL TRANSITIONING FROM A DEVICE TO A WAVEGUIDE

(75) Inventors: Xueru Ding, Chelmsford, MA (US); Allan Scott Douglas, Tyngsboro, MA (US)

(73) Assignee: Tyco Technology Resources, Wilmington, DE (US)

( * ) Notice: Subject to any disclaimer, the term of this patent is extended or adjusted under 35 U.S.C. 154(b) by 0 days.

(21) Appl. No.: 10/610,296

(22) Filed: Jun. 30, 2003

(65) Prior Publication Data

US 2004/0263277 A1 Dec. 30, 2004

(51) Int. Cl.
*H01P 5/08* (2006.01)

(52) U.S. Cl. ..... 333/26; 333/21 R; 333/33

(58) Field of Classification Search ..... 333/21 R, 333/33, 26; 343/776; 381/181
See application file for complete search history.

(56) References Cited

U.S. PATENT DOCUMENTS

| | | | | |
|---|---|---|---|---|
| 3,383,630 | A * | 5/1968 | Kuroda | 333/137 |
| 3,969,691 | A * | 7/1976 | Saul | 333/21 R |
| 4,039,975 | A * | 8/1977 | Debski | 333/122 |
| 4,074,265 | A * | 2/1978 | True | 333/122 |
| 4,409,566 | A | 10/1983 | Patton et al. | 333/26 |
| 4,679,249 | A * | 7/1987 | Tanaka et al. | 455/328 |
| 4,754,239 | A | 6/1988 | Sedivec | |
| 4,980,659 | A * | 12/1990 | Allard | 333/33 |
| 5,083,099 | A * | 1/1992 | Lagerlof | 333/21 R |
| 5,280,253 | A | 1/1994 | Deki et al. | 333/26 |
| 5,311,153 | A * | 5/1994 | Lau et al. | 333/26 |
| 5,374,938 | A * | 12/1994 | Hatazawa et al. | 343/756 |

(Continued)

FOREIGN PATENT DOCUMENTS

| | | |
|---|---|---|
| EP | 0 986 123 A2 | 3/2000 |
| GB | 981 448 A | 1/1965 |

OTHER PUBLICATIONS

Jifu Huang et al. "Frequency-domain TLM analysis of the transition from rectangular to circular waveguides" Microwave Symposium Digest, 1994., IEEE MIT-S International San Diego, CA, USA May 23-27, 1994, pp. 705-708, XPO10586681.

Yi-Chi Shib, Thuy-Nhung Ton, and Long Q. Bui; Waveguide-to-Microstrip Transitions for Millimeter-Wave Applications; 1998 IEEE MTT-S Digest, no month.

M. Akaike, H. Kato and S. Yuki; Oscillation Characteristics of Millimeter-Wave IMPATT Diodes Mounted in Low-Impedance Waveguide Mounts; IEEE Transactions on Microwave Theory and Techniques Mar. 1968.

J. H. C. van Heuven; "A New Integrated Waveguide-Microstrip Transition"; IEEE Transactions on Microwave Theory and Techniques Mar. 1976.

*Primary Examiner*—Vibol Tan

(57) ABSTRACT

A signal transmission apparatus includes a first waveguide, a second waveguide and a third waveguide. The transitions between the first, second and third waveguides are substantially co-impedance matched. The signal transmission apparatus may be a multi-port device, and may be used to transition high frequency signals from one component to another in a variety of applications.

34 Claims, 11 Drawing Sheets

U.S. PATENT DOCUMENTS 5,760,660 A * 6/1998 Nagatsu et al. ..... 333/126
5,886,588 A * 3/1999 Schneider ..... 333/21 R
5,969,580 A * 10/1999 Maillet et al. ..... 333/26
6,087,907 A 7/2000 Jain
6,396,363 B1 5/2002 Alexanian et al.
6,473,472 B1 * 10/2002 Uchiki et al. ..... 375/341
6,509,874 B1 1/2003 Kolak et al.
6,573,803 B1 6/2003 Ziegner et al.

* cited by examiner

*FIG. 9*

900

| | P-a(dBm) | P-b(dBm) | P-c(dBm) |
|---|---|---|---|
| 901 | 11.67 | 11.57 | 11.59 |
| 902 | 10.89 | 11.35 | 11.03 |
| △(dB) | 0.78 | 0.22 | 0.56 |

Table 1

APPARATUS FOR SIGNAL TRANSITIONING FROM A DEVICE TO A WAVEGUIDE

BACKGROUND

The use of radio frequency (RF), microwave, millimeter (mm) wave, and other high frequency (HF) electromagnetic radiation is common in communication systems, consumer electronics and automotive applications.

The transitioning of high frequency electromagnetic signals from one element to another can result in significant noise and losses, which can ultimately impact the performance of a component or system. One significant source of loss in high frequency applications is impedance and reactance mismatch (often referred to only as impedance mismatch) between the components that are coupled to effect the propagation of the high frequency signal.

Autonomous cruise control (ACC) systems are mm-wave radar-based, and are used to safely control the speed of an automobile. The ACC system adjusts a vehicle's speed based on signals reflected from vehicles and objects in the vehicle's proximity. This requires a well-focused antenna, which HF signals from the ACC electronics mounted on the vehicle. As such, it is necessary for the ACC signals to transition from electronic components to the antenna structure. This signal transition is often carried out by coupling a microstrip transmission line (microstrip) to an antenna feed, which is an electromagnetic waveguide. At frequencies of operation, the ACC antenna feeds are often rectangular and circular waveguides.

Impedance mismatch between the microstrip and the antenna feed can result in significant insertion and return losses, which have a deleterious impact on the signal strength and thus the performance of the ACC system.

Known apparati and techniques used to effect the transition from the electronic devices to the antenna of the ACC suffer from mechanical instability, poor isolation and return losses, and excessive manufacturing costs.

Accordingly, what is needed is an apparatus, which couples high frequency signals from electronic devices to waveguides and which overcomes at least the deficiencies of the apparati described above.

DEFINED TERMS

As used herein, the term 'unitary' means comprised of more than two parts, which are fastened together to form a single component. The term 'integral' means comprised of an indivisible part. For example, a unitary element may have a plurality of parts fastened together, whereas an integral element may be cast from a mold.

SUMMARY

In accordance with an exemplary embodiment, a signal transition apparatus includes a first waveguide, a second waveguide and a third waveguide. The transitions between the first, second and third waveguides are substantially co-impedance matched.

In accordance with another exemplary embodiment, a signal transition apparatus includes a ridge waveguide, a first rectangular waveguide, and a circular waveguide.

In accordance with another exemplary embodiment, a multi-port device includes a plurality of signal transition apparati, and each of the signal transition apparati includes a ridge waveguide, a first rectangular waveguide, and a circular waveguide.

BRIEF DESCRIPTION OF THE DRAWINGS

The invention is best understood from the following detailed description when read with the accompanying drawing figures. It is emphasized that the various features are not necessarily drawn to scale. In fact, the dimensions may be arbitrarily increased or decreased for clarity of discussion.

FIG. 9 is a tabular representation of the output power of a three-port device of an exemplary embodiment and that of a known device at 77 GHz.

DETAILED DESCRIPTION

Figure 1:
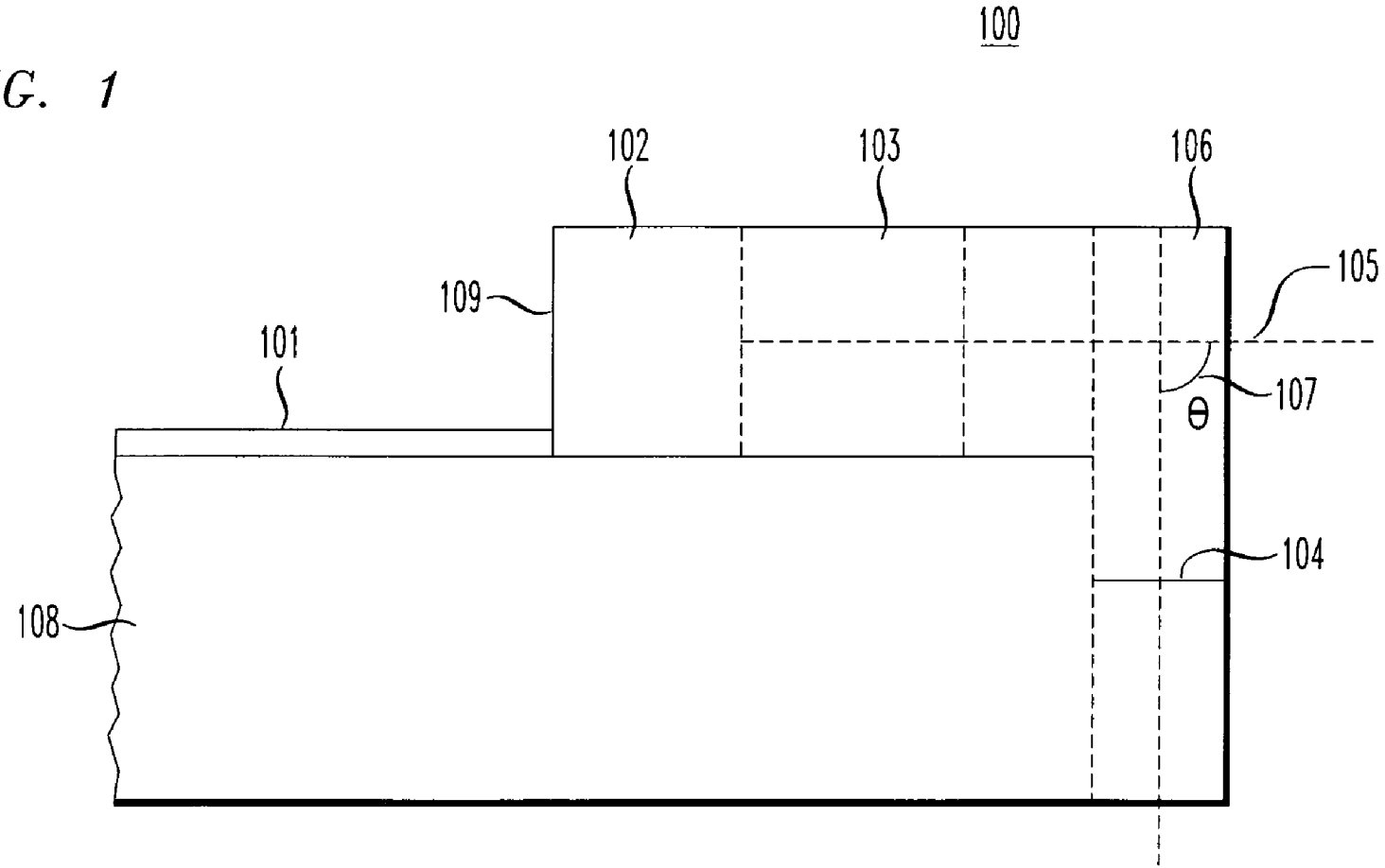
FIG. 1 is a conceptual view of a signal transition apparatus in accordance with an exemplary embodiment.

In the following detailed description, for purposes of explanation and not limitation, exemplary embodiments disclosing specific details are set forth in order to provide a thorough understanding of the present invention. However, it will be apparent to one having ordinary skill in the art having had the benefit of the present disclosure, that the present invention may be practiced in other embodiments that depart from the specific details disclosed herein. Moreover, descriptions of well-known devices, methods and materials may be omitted so as to not obscure the description of the present invention. Finally, wherever applicable and practical, like reference numerals refer to like elements.

FIG. 1 shows a signal transition apparatus (STA) 100 in accordance with an exemplary embodiment. The STA 100 includes a member 109 that is disposed over a baseplate 108. As will become clearer as the present description proceeds, the STA 100 provides the impedance transformation from the device to a component (not shown) and transforms the mode(s) of the device to the mode(s) of the component. This component may be a passive component such as an antenna.

The device 101 is disposed over the baseplate, and may include a high frequency integrated circuit, passive or active high frequency components, or a combination thereof that. The device 101 may also include one or more planar transmission lines such as asymmetric strip/microstrip signal transmission lines (microstrip or microstripline) with the baseplate functioning as a ground plane of the transmission lines.

The member 109 includes a first waveguide 102, a second waveguide 103 and a third waveguide 104. The first waveguide 102 is adapted to couple to the device 101, and to provide mode conversion of the mode(s) of the device 101 to the waveguide mode(s) of the first waveguide. For example, in the event that the connection to the device is via a microstrip, the first waveguide 102 converts the quasi-TEM mode of the microstrip to the mode(s) of the first waveguide. The first waveguide 102 is also adapted to couple the signal to the second waveguide 103. Likewise, the second waveguide 103 is adapted to couple the signal to the third waveguide 104, which couples the signal to another device, not shown. The contiguous elements of the STA 100 are substantially co-impedance matched. To wit, the transitions across the contiguous waveguides of the STA are co-matched. This allows the resultant structure of the STA 100 to be relatively compact, and to have adequate performance characteristics.

The second waveguide 103 and third waveguide 104 are disposed at an angle 107 (θ) formed by the intersection of an axis 105 of the second waveguide 103 (and thus of the device 101) and an axis 106 of the third waveguide 104. In the embodiment shown in FIG. 1, this angle 107 is approximately 90°. As such, the signal from the device 101 will ultimately travel in a direction that is orthonormal to its original direction of propagation.

As will become clearer as the description proceeds, this orthonormal change in propagation direction may be advantageous in certain applications of the embodiments, such as providing a feed to an antenna in an ACC device. However, in other applications, it may be useful to have the direction of propagation changed to another direction, or not at all. As such, angle 107 may be in the range of approximately 0° to approximately 90°.

According to an illustrative embodiment, fourth waveguide 110 may be disposed between the second and third waveguides 103, 104, respectively, and may be substantially a quarter wave transformer. The fourth waveguide 110 usefully provides impedance and mode matching between the second and third waveguides, and thereby improves the transmission characteristics. For example, if the connection from the device 101 to the STA 100 is a microstrip, and the third waveguide 104 is a circular waveguide, the fourth waveguide may facilitate the efficient transformation of higher order modes of the first and second waveguides into the dominant mode of the circular waveguide.

The member 109 and the baseplate 108 illustratively are made of a material suitable for use in high frequency signal transmission applications. For example, in signal transmission applications at frequencies of approximately 74.0 GHz to approximately 79.0 GHz, the STA 100 may be made of aluminum, brass, copper, or other metal/metal alloy. It is noted that the referenced frequency range and materials are offered for exemplary purposes and is not intended to limit the purview of the embodiments. For example, the STA 100 may be useful in providing mode and impedance transformations from the device 101 to the component, where the signal is of a frequency in the range of approximately several hundred MHz to less than approximately 200 GHz, and may be made of materials suitable for signal transmission at the particular frequency range chosen.

Illustratively, the member 109 is an integral element, and may be cast from a suitable material such as a suitable metal or metal alloy. Alternatively, the member 109 may be a unitary element comprised of individual components, which are fastened together by a suitable fastener such as screws, by conductive adhesive material, by soldering, or by a combination thereof. In accordance with another exemplary embodiment, the member 109 and the baseplate 108 may be integral. Alternatively, the member 108 and the baseplate 109 may be separate elements fastened together with a suitable fastener such as screws, solder, or conductive adhesive.

Characteristically, the STA 100 and its constituent components are waveguide structures and do not include dielectric materials (other than air). As such, ohmic loss that is normally dominated by tangent loss of dielectric material, especially at high frequencies such as 77 GHz, is minimized if not substantially eliminated through the use of the STA 100. As can be readily appreciated, the substantial elimination of tangent loss and the substantial co-impedance matching across the contiguous waveguides of the exemplary embodiments result in improved insertion loss and return loss in the signal transition from the device 101 to a guiding structure such as an antenna feed. Moreover, and as described in greater detail herein, it is noted that in the present and other exemplary embodiments, the STA 100 affords signal transitioning from a device to a waveguide via a substantially compact structure. Again, this is attributable to the co-matching of the waveguides of the STA 100.

Beneficially, the STA 100 of the illustrative embodiments described above functions as an impedance and mode transformer between the device 101 and the third waveguide 104, which may be oriented at an angle of approximately 0 degrees to approximately 90 degrees relative to an axis of the device.

Prior to continuing with a description of other illustrative embodiments, it is noted that the various materials, characteristics, features and uses of the STA 100 may be incorporated into the embodiments described below. Likewise, the various materials, characteristics, features and uses of the embodiments described below also may be incorporated into the STA 100.

FIGS. 2*a*–2*d* show an STA 200 in accordance with an exemplary embodiment. Illustratively, the STA 200 transforms the quasi-TEM mode of a microstrip 214 to the dominant mode (e.g., the $H_{11}$ mode) of a circular waveguide 211 in a compact structure that has improved performance characteristics compared to known devices.

In one illustrative embodiment, the STA 200 is useful in coupling ACC system circuitry to the ACC system antenna via an antenna feed. The ACC circuitry includes a signal source, which generates signals that are transmitted by the antenna. The signal source may include a Gunn oscillator, a metal-semiconductor field effect transistor (MESFET) based oscillator, or a pseudomorphic high electron mobility transistor (pHEMT) based oscillator. It is noted, however, that the implementation of the STA 200 in an ACC is merely illustrative, and the STA 200 may be used in coupling other high frequency components to waveguides in many other applications. For example, the STA 200 may also be used to couple HF electromagnetic signals between elements in other applications such as point-to-point, point-to-multipoint and multipoint-to-multipoint communication systems.

In an exemplary embodiment, the STA 200 comprises a member 201 disposed over a baseplate 210. The baseplate illustratively includes the microstrip 214 with a signal line conductor 202. The microstrip 214 is coupled at one end to one or more electronic devices (not shown), as well as passive components (not shown) that may be used in a high frequency circuit (not shown); and at the other end to the member 201 at a point 203. As will become clearer as the present description proceeds, the STA functions as an impedance and mode transformer, and fosters efficient coupling of the signal from the microstripline 214 to a circular waveguide 211, which illustratively functions as a feed to an ACC antenna (not shown).

As shown in various views in FIGS. 2*a*–2*d*, the member 201 includes a ridge waveguide 205, a first rectangular waveguide 207 in a region 206, and a circular waveguide 209. In addition, when joined, the member 201 and the baseplate 210 include a second rectangular waveguide 215 comprised of an upper portion 208 and lower portions 212. Moreover, when the member 201 and the baseplate 210 are joined, the circular waveguide 209 of the member 201 is coupled to the circular waveguide 211 of the baseplate 210, and is essentially electrically continuous therewith. Accordingly, when the baseplate 210 and the member 201 are joined, the circular waveguides 209 and 211 may be considered essentially as a single circular waveguide.

The ridge waveguide 205 is illustratively a two-step device and functions as the primary impedance transformer between the microstrip 214 and the first rectangular waveguide 207. The ridge waveguide 205 also provides efficient mode transformation of the quasi-TEM mode of the microstrip 214 to the mode(s) of the first rectangular waveguide 207. The ridge waveguide 205 usefully provides a compact substantially quarter-wave impedance transformation between the microstrip 214 and the waveguides of the member 201 and the baseplate 210. To wit, in order to assist the signal transition from the microstripline 214 to the circular waveguide 211 in a compact yet efficient manner, the ridge waveguide 205 is employed.

It is noted, however, that the ridge waveguide 205 may comprise more or fewer steps than shown, and that other waveguides may be used to effect this initial transformation. The selection of the particular waveguide here is dependent on the impedance characteristics of the microstrip 214, the circular waveguide and the waveguides of the STA 200; and is chosen to substantially optimize the impedance matching therebetween and the transformation of waveguide modes from one waveguide to another.

In order to substantially prevent electrical discontinuities between the microstripline 214 and the waveguide 205, the bottom step 204 of the waveguide 205 is attached to the signal line 202 at a single contact point 203 using a suitable conductive adhesive such as conductive epoxy or solder. Ultimately, the single contact also fosters an improved insertion loss and an improved return loss over a particular frequency range as compared to known structures.

Figure 2A:
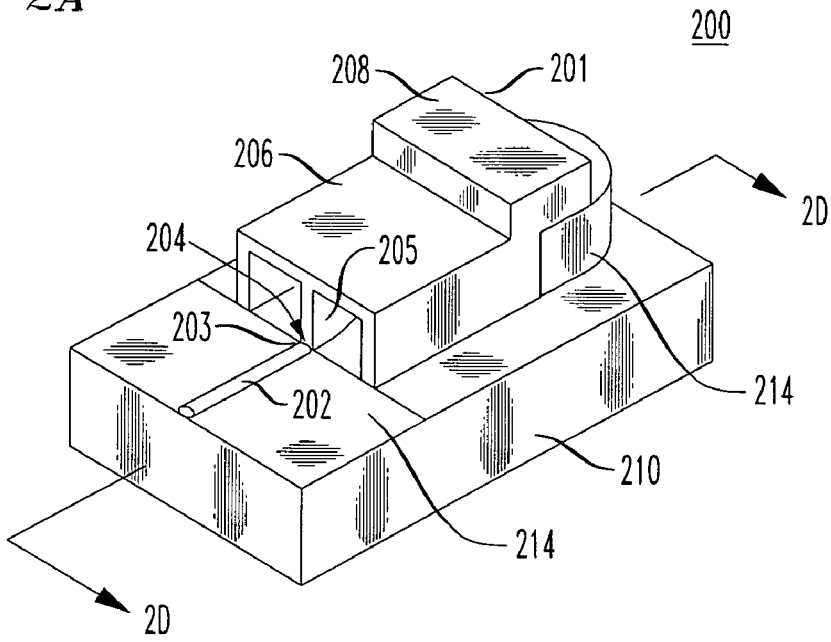
FIG. 2*a* is a perspective view of a signal transition apparatus in accordance with an exemplary embodiment.
Figure 2B:
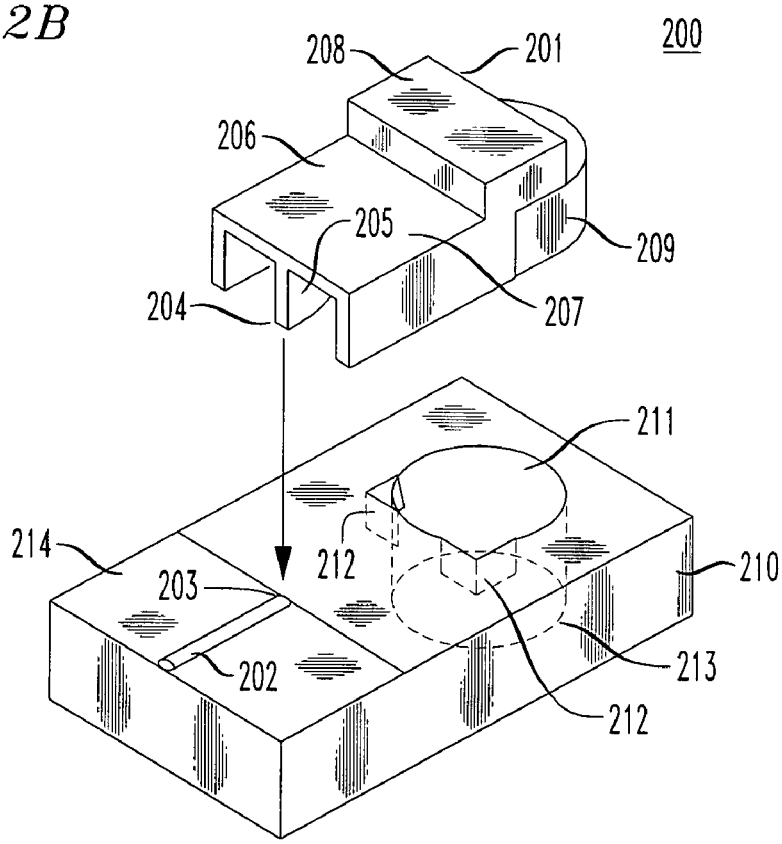
FIG. 2*b* is a partially exploded view of the signal transition apparatus of FIG. 2*a*.
Figure 2C:
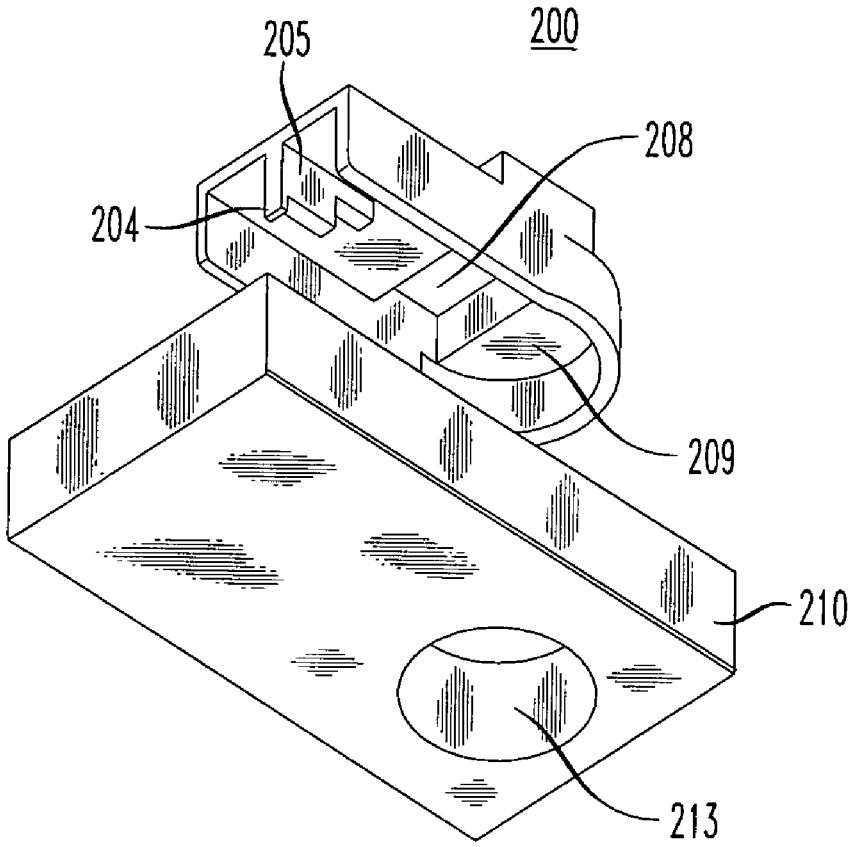
FIG. 2*c* is a partially exploded view of the signal transition apparatus of FIG. 2*a*.
Figure 2D:
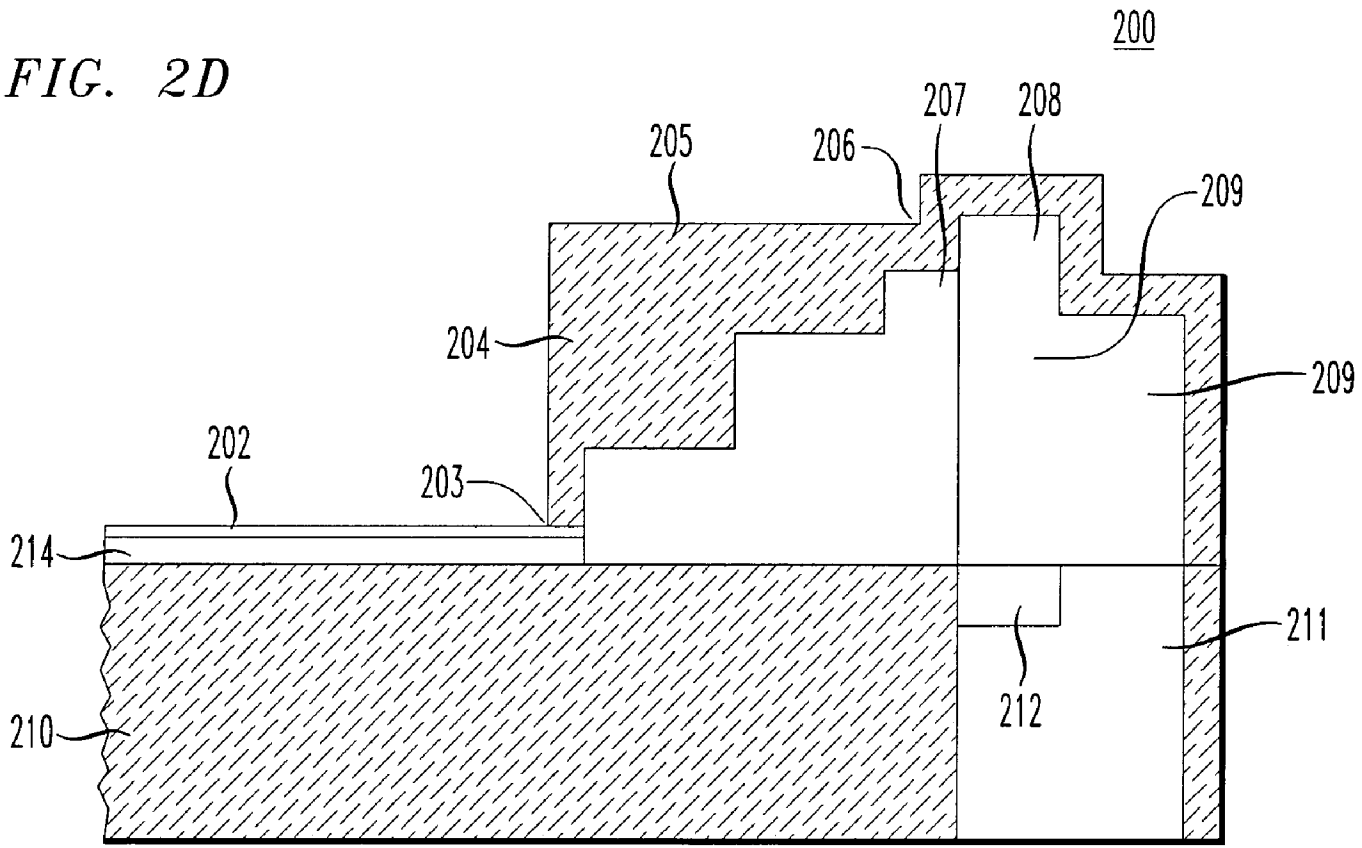
FIG. 2*d* is a cross-sectional view of the signal transition apparatus of FIG. 2*a* taken along the line 2*d*—2*d*.

As stated, the ridge waveguide 205 couples the signal from the microstripline 214 to a first rectangular waveguide 207. The rectangular waveguide 207 is coupled to the second rectangular waveguide 215 comprised of the upper portion 208 and lower portions 212. Illustratively, the second rectangular waveguide 215 has a greater height (e.g., as shown in FIG. 2*d*) compared to the height of the first rectangular waveguide 207. In addition, it is noted that the length of the first rectangular waveguide 207 may be smaller than that of the second rectangular waveguide 215. In fact, in an exemplary embodiment the length of the first rectangular waveguide 207 may be relatively small, or the first rectangular waveguide 207 may be omitted entirely.

The second rectangular waveguide 215 acts is a substantially quarter wave transformer that provides impedance matching between the first rectangular waveguide 207 and the circular waveguide 209/211. The second rectangular waveguide 215 also provides an angular transformation between the first waveguide section 207 and the circular waveguide 209. Moreover, a variety of higher order waveguide modes are supported by the waveguides of the STA 200. The second rectangular waveguide 215 facilitates the transformation of these modes into the dominant mode of the circular waveguide 209.

The signal from the second rectangular waveguide 215 is then coupled to a circular waveguide 209 and then to the circular waveguide 211. An output 213 of the circular waveguide 211 may be fed to an antenna feed or other circular waveguide devices. Additionally, the circular waveguide 209/211 may itself be the antenna feed of an antenna. It is noted that this is merely illustrative, and that the output may be coupled to other waveguides, which are not circular.

The contiguous waveguides of the STA 200 usefully are substantially co-impedance matched to one another. As such, the transitions from the ridged waveguide 205 to the first rectangular waveguide 207; from the first rectangular waveguide 207 to the second rectangular waveguide 215; and from the second rectangular waveguide 215 to the circular waveguide 209/211 are co-matched. This reduces reflections, and improves the insertion loss and return loss in a comparatively very limited space/compact device compared to known structures.

The member 201 and the baseplate each may be integral elements. Alternatively, the member 201 may be a unitary element structure. The STA 200 may be made of suitable metals/metal alloys for signal transmission at a particular frequency range. For example, the STA 200 may be made of copper, brass, aluminum or alloys thereof. In any event, the STA 200 is a waveguide-based signal transmission device that does not incorporate dielectric materials (except air), which are a significant source of tangent loss. This also improves the insertion loss characteristics compared to known structures. Moreover, in the exemplary embodiments described herein, the dimensions of the various elements of the STA 200 are chosen to provide the desired co-impedance matching and mode matching. Of course, this applies to the embodiments described in connection with FIGS. 1 and 3–6 as well. Finally, the structure is usefully compact in size, which can be advantageous in many applications, such as ACC. This is effected in part by having the waveguides of the STA 200 in a single part with waveguides transitioning from one to the next, and by having some overlap between the waveguides.

It is noted that the waveguides of the STA 200 are illustrative of the embodiments and are not intended to be limiting thereof. As such, waveguides and impedance transformation devices other than those described may be used. For example, elliptical waveguides could be used instead of circular waveguides. Furthermore, fewer or more waveguides and transformers could be used. Finally, tuning elements (not shown) could also be used as needed to improve matching.

Figure 3:
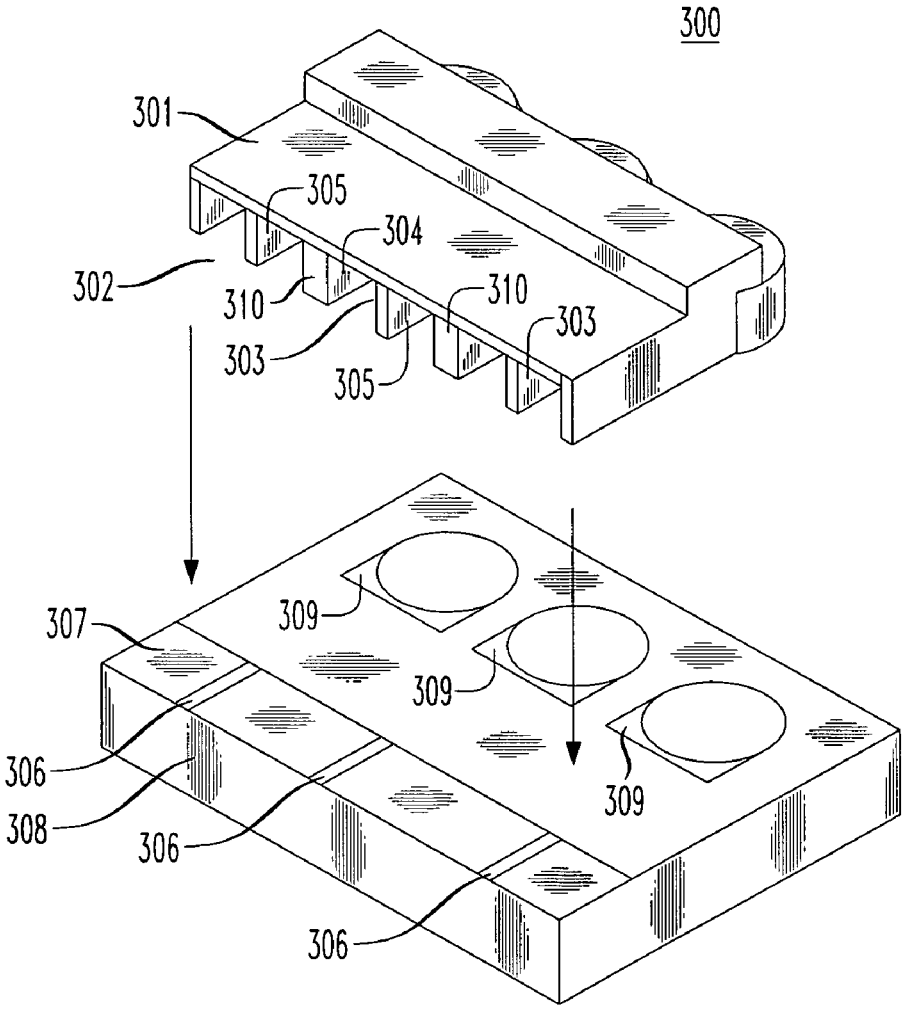
FIGS. 3 is a partially exploded view of a signal transition apparatus including a plurality of signal coupling apparati in accordance with an exemplary embodiment.

FIG. 3 shows a three channel STA 300 in accordance with an exemplary embodiment. The STA 300 is substantively the same as the STA 200 shown in FIGS. 2*a*–2*d*, being comprised of substantially the same elements and materials, but includes three individual STA devices in a single member 301, and allows for three signals to be transmitted. As such, wherever possible, so as to not to obscure the description, the description of elements, materials, features and uses that are common to the embodiments of FIGS. 2*a*–2*d* and FIG. 3 will be foregone. It is further noted that the STA 300 could be comprised of a plurality of signal transition apparati described in conjunction with FIG. 1 described previously and FIGS. 4*a*–6 *described herein.*

The STA 300 includes a member 301 having three individual signal transition apparati 302, 303 and 304, each of which transmits a particular channel (signal). The STA also includes a baseplate 308. Each of the transition apparati 302–304 includes a ridge waveguide 305, which connects the STA 300 to a respective signal line 306 of a microstripline 307 that is connected to a device (not shown). The microstripline 307 is disposed over the baseplate 308, which has circular waveguides 309 that couple to the respective circular waveguides of the member 301. In order to provide sufficient isolation between the individual transition apparati 302–304, dividers 310 are disposed between the individual transition apparati 302–304.

The STA 300 may be a unitary component, and comprised of individual STA's fastened together using a suitable conductive fastener, such as referenced previously. Alternatively, the STA 300 may be an integral component. In either case the STA 300 may be fabricated from metals and metal alloys as described above, and does not include dielectric materials (except air). The STA 300 may be comprised of the STA's described in other exemplary embodiments herein, and one or more of the individual signal transition apparati 302–304 may be different. For example, one of the signal transition apparati 302–304 may be of the embodiment of FIG. 6, and the other may be of the embodiment of FIG. 2*a*. Furthermore, the three port STA 300 is merely illustrative, and it is noted that more or fewer ports may be used. For example, certain ACC systems will incorporate a five beam or seven beam antenna for wider angular detection. As such, a five or seven port variant of the embodiment of FIG. 3 would readily effect the transition of five or seven signals, respectively.

Illustratively, the STA 300 is used as an antenna feed for three individual channels of an ACC (not shown). The ACC is installed in a vehicle, and usefully provides certain control of the vehicle, based on reflections of signals emitted by an antenna. The antenna in the present exemplary embodiment includes three antenna elements, which create antenna patterns (lobes) that cover a defined area in the front and to the sides of the vehicle. As is well known, it is necessary to transmit the beams of the ACC signal at a great enough arc length to cover the lane of the vehicle and a certain amount on either side thereof. However, if the arc length is too great unwanted reflections from the surrounding roadside or other vehicles may result in false readings and reactions by the ACC. Moreover, the ACC must emit beams that substantially do not have shadows or nodes.

By virtue of the compact structure of the member 301 and its individual signal transition apparati 302–304, an antenna pattern is realized that allows for accurate detection of vehicles and objects in the vehicles path, while not being too great in breadth to detect vehicles too far outside of the vehicle's path. Moreover, the use of circular waveguides as the antenna feeds is useful in forming a sharp signal beam both vertically and horizontally with an antenna in a limited space. Further the shape of the circular waveguides 309 provides a larger contact area for the walls of the divider 310 to contact to baseplate 308 when mounted thereto. This fosters adequate isolation of the signal of one channel (of one of the signal transition apparati) from neighboring channels. Of course, this can improve the channel isolation in the antenna pattern, and thus the ACC performance.

Figure 4A:
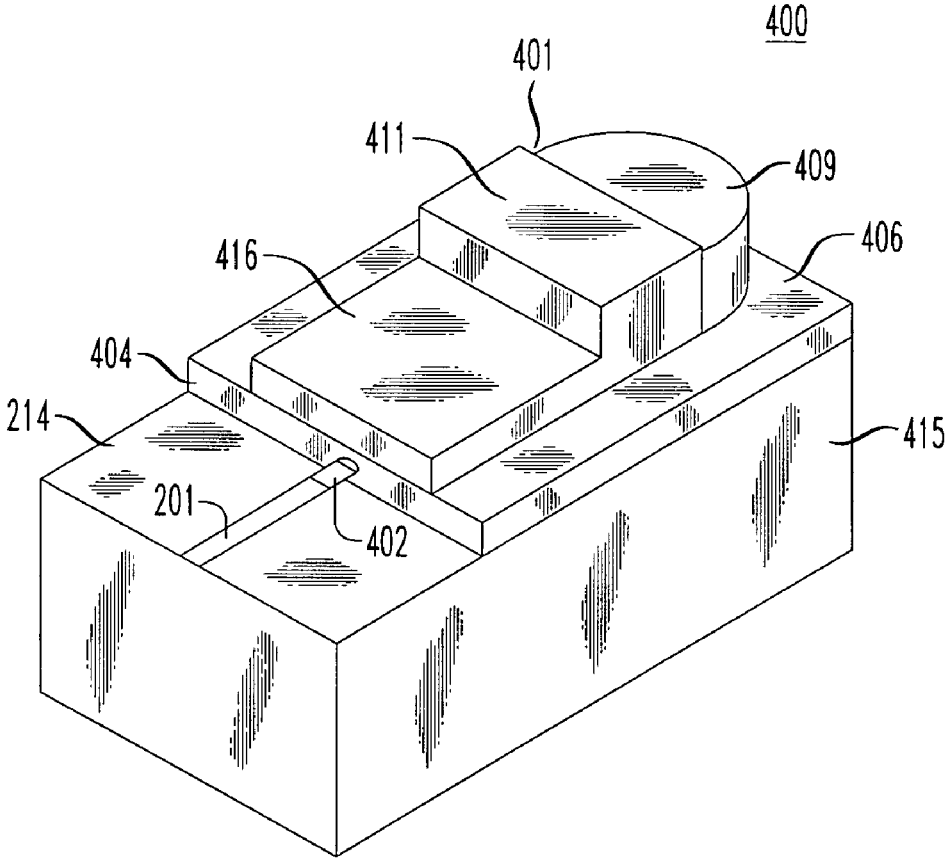
FIG. 4*a* is a perspective view of a signal transition in accordance with an exemplary embodiment.
Figure 4B:
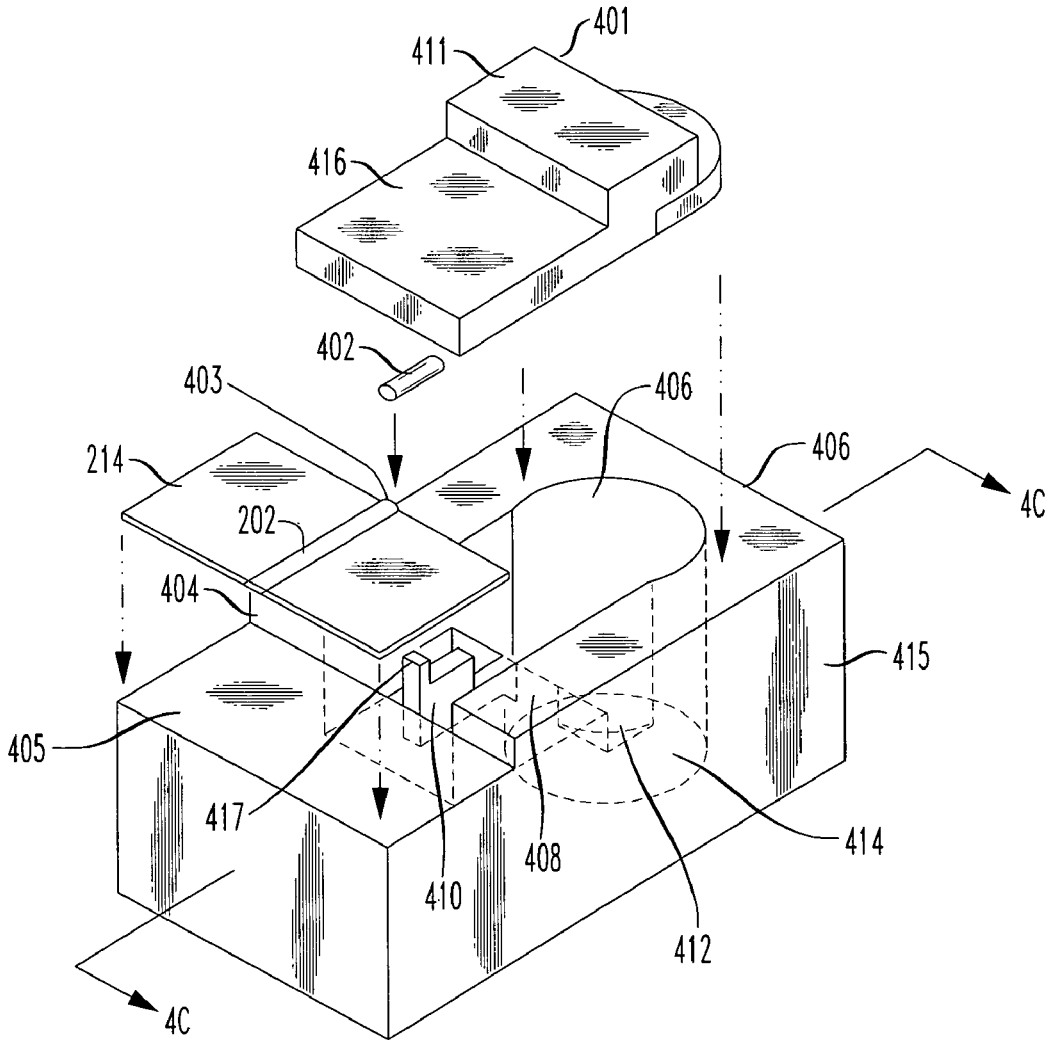
FIG. 4*b* is a partially exploded view of a signal transition apparatus in accordance with an exemplary embodiment.
Figure 4C:
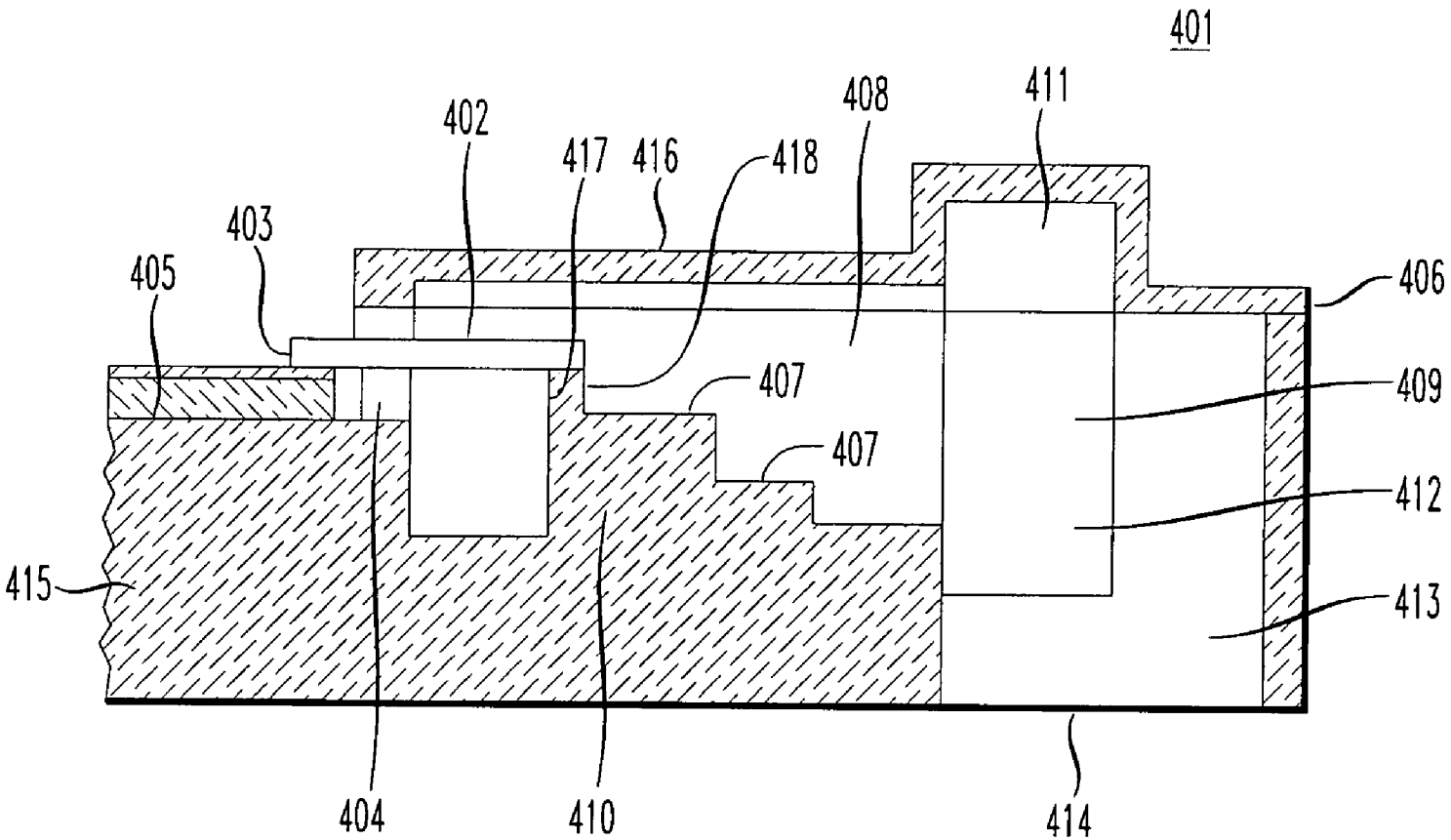
FIG. 4*c* is a cross-sectional view of the signal transition apparatus of FIG. 4*a* taken along line 4*c*—4*c*.

FIGS. 4*a*–4*c* show another exemplary embodiment. In this embodiment, many features, materials, characteristics and uses are the same as those described previously in connection with exemplary embodiments. Again, wherever possible, in order to not obscure the description of the present embodiment, descriptions of common elements, structures and materials will not be repeated.

Illustratively, and as viewed most readily in FIGS. 4*b* and 4*c*, a STA 400 includes a member 401 disposed over a baseplate 415. A microstripline 214 is disposed over the baseplate 415 being illustratively fastened directly thereto using a conductive adhesive such as a suitable solder or conductive epoxy (not shown). A stub 402 is connected to the signal line 202 of the microstripline 214 at a single point 403 and to a ridge waveguide 410 at another point 417 using a conductive material such as conductive epoxy, solder or the like. The ridge waveguide 410 is arranged in a lower portion of the baseplate 415 as shown. To accommodate the differential in the height between the top surface 406 of the baseplate 415 and the top 'step' 418 of the ridge waveguide 410, a step 404 may be provided between a lower level 405 and the top surface 406. This allows the stub 402 to be oriented substantially level with the signal line 202 and the top 'step' 418 of the ridge waveguide 410, while allowing the top step of the ridge waveguide to be at a level that is vertically lower than that of the top surface 406.

The materials used for and the dimensions of the stub 402 are selected to achieve the proper impedance transformation from the microstripline 214 to the ridge waveguide 410. In particular, the stub 402 is essentially a coaxial-like transmission line that substantially provides impedance matching between the microstripline 214 and the ridge waveguide. Additionally, the stub 402 provides an efficient transformation of the quasi-TEM mode of the microstrip to the modes of the ridge waveguide 410.

As viewed most readily in FIG. 4*c*, the ridge waveguide 410 includes at least one step 407. The ridge waveguide 410 acts as an impedance transformer between the stub 402 and a first rectangular waveguide 408, with the member 401 having a region 416 over the ridge waveguide 410 and the first rectangular waveguide 408. A second rectangular waveguide 409 has a greater height than that of the first rectangular waveguide 408, and has portions 411 and 412 in the member 401 and in the baseplate 415, respectively. The dimensions of the second rectangular waveguide 409 are greater in the vertical dimension than those of the first rectangular waveguide 408 in order to provide impedance matching between the first rectangular waveguide 408 and a circular waveguide 413. Additionally, the second rectangular waveguide 409 provides facilitates the mode transformation of the first order and higher order modes of the ridge waveguide 410 and the first rectangular waveguide 408 to a dominant mode of the circular waveguide 409.

As with previous embodiments, each of the transitions between contiguous waveguides of the STA 400 is co-impedance matched, providing improved performance and a compact structure. Furthermore, the impedance and mode transformer comprised of the stub 402, the ridge waveguide 410 and the first and second rectangular waveguide 408 and 409, respectively, allows the HF electromagnetic signal from the microstrip 214 to emerge from an output and be emitted in a direction that is substantially orthogonal to its original direction of propagation along the microstrip 214. Ultimately, the output 414 is coupled to an antenna or other element (not shown).

In the exemplary embodiment shown in FIGS. 4*a*–4*c*, the member 401 may be secured to the baseplate 415 using suitable fasteners such as screws, or by using solder or conductive epoxy. While the embodiment shown in FIGS. 4*a*–4*c* provides substantially the same electrical performance as the embodiments of FIGS. 2*a*–2*d*, the present exemplary embodiment may be more easily assembled since the parts that are fastened with epoxy or solder are on one 'side' of the STA 400. In particular, the connection between the microstrip 214 and the circular waveguide 413 requires only the soldering of the stub on the same part, namely the baseplate 415. Thereafter the member 401 is secured as referenced. Beneficially, this allows to achieve higher manufacturing tolerances with simpler assembly process. It is noted that the STA 400 may be an integral component or a unitary component and may be made of a suitable metal/metal alloy for the chosen frequency. As with other embodiments, the STA 400 does not include dielectric materials except air.

Figure 5:
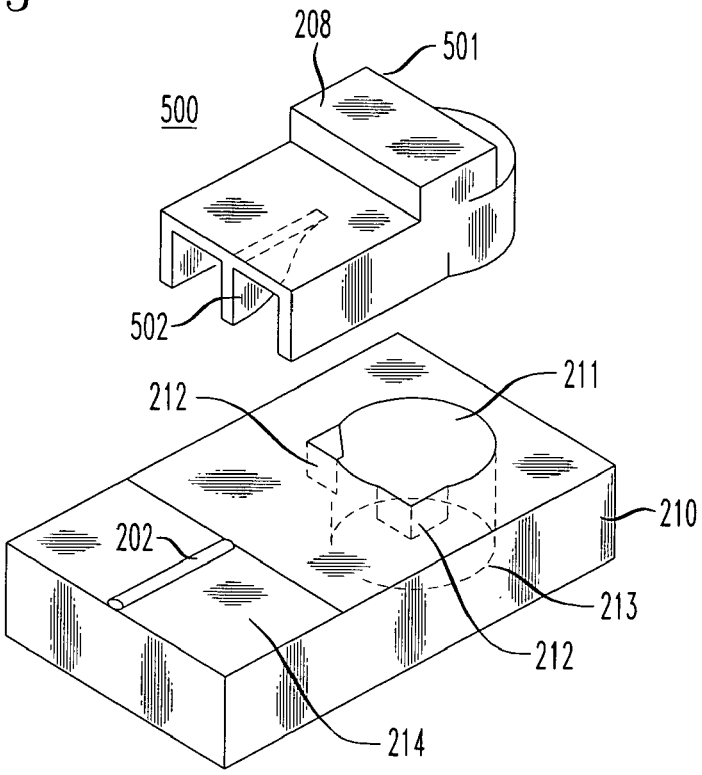
FIG. 5 is a partially exploded view of a signal transition apparatus apparati in accordance with an exemplary embodiment.

FIG. 5 shows an STA 500 in accordance with another exemplary embodiment. The STA 500 includes a member 501 that is substantially identical to the STA 200 of the exemplary embodiment of FIGS. 2*a*–2*d*, except the ridge waveguide used for impedance transformation is a curved ridge waveguide 501.

Figure 6:
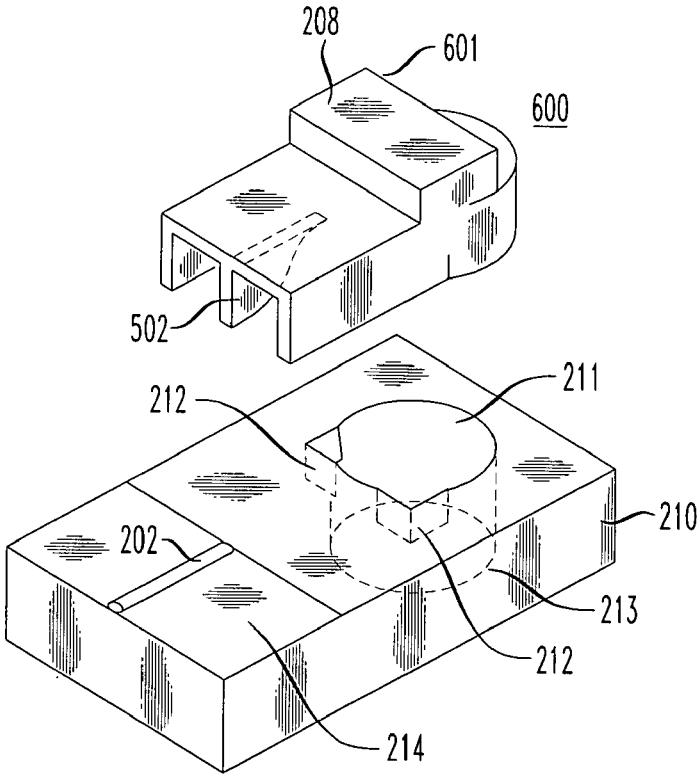
FIG. 6 is a partially exploded view of a signal transition apparatus apparati in accordance with an exemplary embodiment.

FIG. 6 shows an STA 600 in accordance with another exemplary embodiment. The STA 600 is substantially the same as the embodiments of FIGS. 2*a*–2*d* and 6, with the exception of the shape of the ridge waveguide used for impedance transformation. In particular, a taper shaped ridge waveguide 602 is disposed in a member 601.

Figure 7:
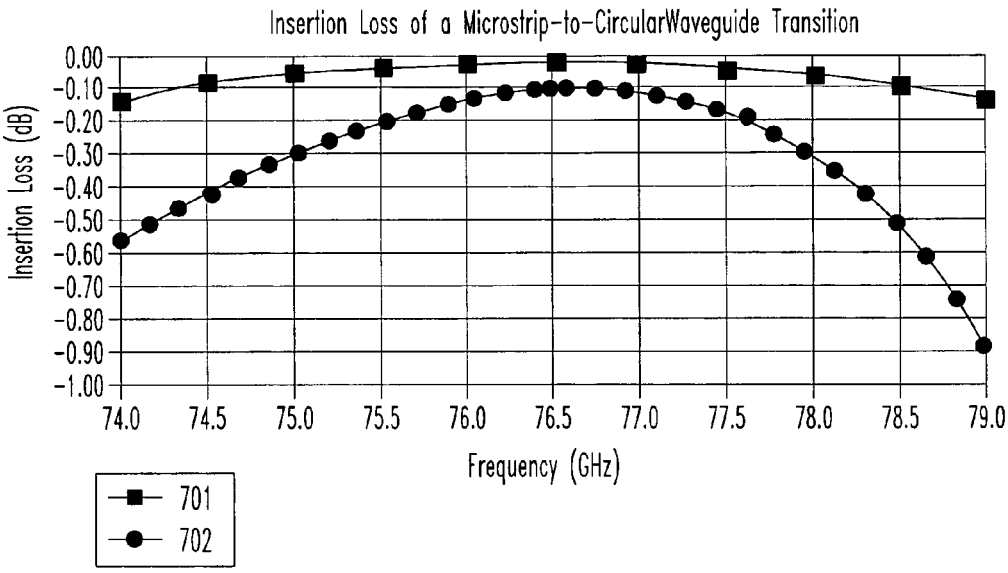
FIG. 7 is a graphical representation of the Insertion Loss versus Frequency of a known device and of a signal transition apparatus in accordance with an exemplary embodiment.
Figure 8:
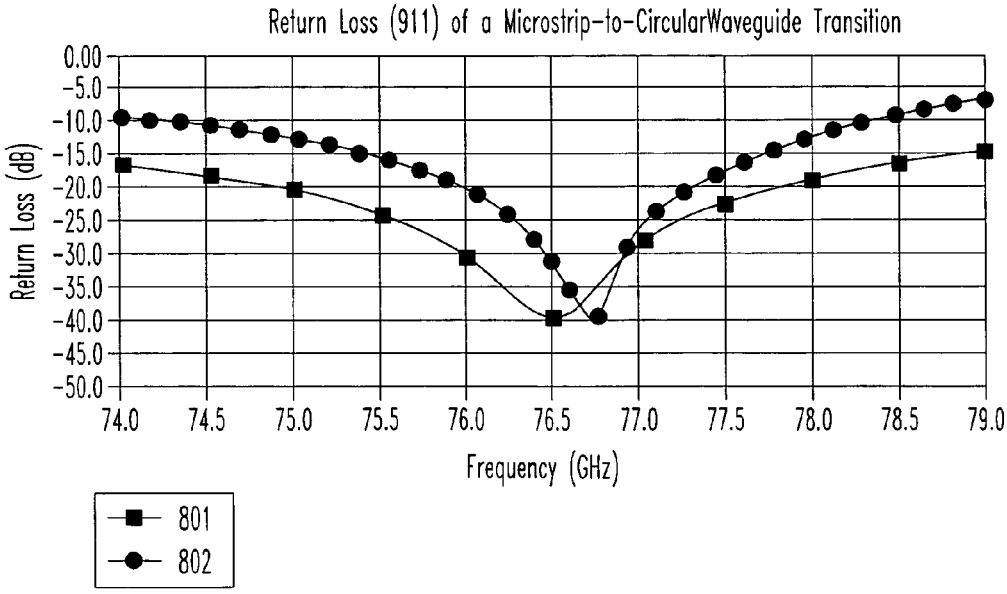
FIG. 8 is a graphical representation of the $S_{11}$ parameter (Return Loss) versus Frequency of a known device and of a signal transition apparatus in accordance with an exemplary embodiment.

FIGS. 7–9 show performance data of exemplary embodiments described above and comparisons of performance data of exemplary embodiments described relative to known devices. It is noted that the ranges of operation and the performance data are merely illustrative.

FIG. 7 is a graphical representation 700 of the simulated Insertion Loss vs. Frequency of an STA in accordance with an exemplary embodiment 701 and that of a known device 702. As can be readily appreciated from a review of the graph 700, the insertion loss of the known device is on the order of approximately 0.10 dB to approximately 0.70 dB greater than that of the STA of an exemplary embodiment.

FIG. 8 is a graphical representation 800 of the simulated Return Loss vs. Frequency of an STA in accordance with an exemplary embodiment 801 and that of a known device 802. As can be readily appreciated from a review of the graph 800, the return loss of the known device has on the order of approximately less than 0.5 times the 15 dB return loss bandwidth of the STA of an exemplary embodiment.

FIG. 9 is a tabular representation 900 of the measured output power data of an exemplary three-port STA of an ACC (901) and that of a known three-port device (902) of an ACC, with each device operating at a nominal 76.5 GHz. As can be readily appreciated the differential in the output power of the STA of the exemplary embodiments and the known device is in the range of approximately 0.22 dB and approximately 0.78 dB.

The invention being thus described, it would be obvious that the same may be varied in many ways by one of ordinary skill in the art having had the benefit of the present disclosure. Such variations are not regarded as a departure from the spirit and scope of the invention, and such modifications as would be obvious to one skilled in the art are intended to be included within the scope of the following claims and their legal equivalents.

The invention claimed is:

1. A signal transition apparatus, comprising:

a first waveguide, a second waveguide and a third waveguide, wherein: the transitions between the first, second and third waveguides are substantially co-impedance matched; and the apparatus is adapted to receive a quasi-transverse electromagnetic (TEM) mode and convert the quasi-TEM mode into at least one other mode.

2. A signal transition apparatus as recited in claim 1, wherein the third waveguide is oriented at an angle relative to the first waveguide.

3. A signal transition apparatus as recited in claim 2, wherein the angle is in the range of approximately 0° to approximately 90°.

4. A signal transition apparatus as recited in claim 1, further comprising a fourth waveguide between the second waveguide and the third waveguide.

5. A signal transition apparatus as recited in claim 1, wherein the first waveguide is coupled to a signal transmission line and the third waveguide is a circular waveguide.

6. A signal transition apparatus as recited in claim 1, wherein the apparatus is a unitary component.

7. A signal transition apparatus as recited in claim 1, wherein the apparatus is an integral component.

8. A signal transition apparatus as recited in claim 1, wherein the apparatus does not include any dielectric material having a dielectric constant greater than air.

9. A signal transition apparatus as recited in claim 8, wherein the apparatus is comprised of a metal or a metal alloy.

10. A signal transition apparatus, comprising:

a ridge waveguide coupled to a device, which includes at least one planar transmission line;

a rectangular waveguide; and a circular waveguide.

11. A signal transition apparatus as recited in claim 10, wherein the rectangular waveguide and the circular waveguide are oriented at an angle relative to one another.

12. A signal transition apparatus as recited in claim 11, wherein the angle is in the range of approximately 0° to approximately 90°.

13. A signal transition apparatus as recited in claim 10, further comprising another rectangular waveguide between the ridge waveguide and the rectangular waveguide.

14. A signal transition apparatus as recited in claim 13, wherein the ridge waveguide is contiguous with the another rectangular waveguide, the rectangular waveguide is contiguous with the circular waveguide, the another rectangular waveguide is contiguous with the rectangular waveguide, and the waveguides are co-impedance matched.

15. A signal transition apparatus as recited in claim 10, wherein the ridge waveguide is contiguous with the rectangular waveguide, the rectangular waveguide is contiguous with the circular waveguide, and the waveguides are co-impedance matched.

16. A signal transition apparatus as recited in claim 13, wherein the rectangular waveguide has a height that is greater than a height of the another rectangular waveguide.

17. A signal transition apparatus as recited in claim 10, wherein the device includes a microstrip transmission line.

18. A signal transition apparatus as recited in claim 17, wherein a stub is disposed between the ridge waveguide and the microstrip transmission line.

19. A signal transition apparatus as recited in claim 10, further comprising a baseplate and a member over the baseplate.

20. A signal transition apparatus as recited in claim 19, wherein the member includes the ridge waveguide, the circular waveguide and a portion of the rectangular waveguide.

21. A signal transition apparatus as recited in claim 19, wherein the baseplate includes the ridge waveguide, the circular waveguide and a portion of the rectangular waveguide.

22. A signal transition apparatus as recited in claim 10, wherein the apparatus is an integral component.

23. A signal transition apparatus as recited in claim 10, wherein the apparatus is a unitary component.

24. A signal transition apparatus as recited in claim 10, wherein the signal transition apparatus does not include any dielectric material having a dielectric constant greater than air.

25. A signal transition apparatus as recited in claim 24, wherein the signal transition apparatus is comprised of a metal or a metal alloy.

26. A multi-port device, comprising:

a plurality of signal transition apparati, each of which comprises:

a ridge waveguide;

a rectangular waveguide; and a circular waveguide;

wherein each of the ridge waveguides is coupled to a respective device.

27. A multiport device as recited in claim 26, wherein there is one of the signal transition apparati for each port.

28. A multi-port device as recited in claim 26, wherein the each of the plurality of signal transition apparati is a unitary element comprised of individual signal transition apparati that are fastened together.

29. A multi-port device as recited in claim 26, wherein the plurality of signal transition apparati is an integral element.

30. A multiport device as recited in claim 26, wherein each of the respective devices includes a microstrip transmission line.

31. A multi-port device as recited in claim 26, wherein the multi-port device further comprises at least one member disposed over a baseplate.

32. A multi-port device as recited in claim 26, wherein at least one of the plurality of signal transmission apparati is different than the others.

33. A multi-port device as recited in claim 26, wherein each of the plurality of signal transmission apparati is made of metal or a metal alloy.

34. A multi-port device as recited in claim 26, wherein each of the plurality of signal transmission apparati does not include a dielectric material other than air.

* * * * *